US007930838B2

(12) United States Patent
Bae et al.

(10) Patent No.: US 7,930,838 B2
(45) Date of Patent: Apr. 26, 2011

(54) LAUNDRY DRYER

(75) Inventors: Sang Hun Bae, Changwon-si (KR); Chul Jin Choi, Changwon-si (KR); Dong Hyun Kim, Changwon-si (KR); Young Bok Son, Changwon-si (KR)

(73) Assignee: LG Electronics Inc., Soul (KR)

( * ) Notice: Subject to any disclaimer, the term of this patent is extended or adjusted under 35 U.S.C. 154(b) by 183 days.

(21) Appl. No.: 11/902,084

(22) Filed: Sep. 18, 2007

(65) Prior Publication Data

US 2008/0115381 A1 May 22, 2008

(30) Foreign Application Priority Data

Sep. 18, 2006 (KR) ..... 10-2006-0090093

(51) Int. Cl.
*F26B 11/02* (2006.01)
*F26B 19/00* (2006.01)

(52) U.S. Cl. ..... 34/597; 34/60; 34/603; 34/122; 34/130

(58) Field of Classification Search ..... 34/60, 108, 34/122, 130, 131, 597, 603
See application file for complete search history.

(56) References Cited

U.S. PATENT DOCUMENTS

| | | | | | |
|---|---|---|---|---|---|
| 2,742,708 | A | * | 4/1956 | McCormick | 34/76 |
| 2,846,776 | A | * | 8/1958 | Clark | 34/547 |
| 2,910,854 | A | * | 11/1959 | Hughes | 68/18 R |
| 3,022,656 | A | * | 2/1962 | Bergeson et al. | 68/207 |
| 3,595,036 | A | * | 7/1971 | DePas | 68/12.15 |
| 4,909,988 | A | * | 3/1990 | Childers et al. | 422/26 |
| 5,548,978 | A | * | 8/1996 | Bongini et al. | 68/17 R |
| 5,934,109 | A | * | 8/1999 | Kiefer et al. | 68/17 R |
| 2006/0277690 | A1 | * | 12/2006 | Pyo et al. | 8/149.2 |
| 2007/0151310 | A1 | * | 7/2007 | Wright et al. | 68/3 R |

FOREIGN PATENT DOCUMENTS

| | | | |
|---|---|---|---|
| CN | 1580352 | | 2/2005 |
| DE | 3408136 | | 9/1985 |
| DE | 10260151 | | 7/2004 |
| DE | 102005046163 | | 3/2007 |
| EP | 1441058 | * | 7/2004 |
| EP | 1441059 | | 7/2004 |
| EP | 1 544 345 | | 6/2005 |
| EP | 1 555 340 | | 7/2005 |
| KR | 1020040015957 | * | 2/2004 |
| WO | WO 2004/059070 A1 | | 7/2004 |
| WO | WO 2007/137860 | | 12/2007 |

* cited by examiner

*Primary Examiner* — Kenneth B Rinehart
*Assistant Examiner* — Corey Hall
(74) *Attorney, Agent, or Firm* — McKenna Long & Aldridge LLP

(57) ABSTRACT

The present invention relates to a laundry dryer that can prevent as well as remove wrinkles of laundry. A laundry dryer includes a drum in which laundry is held; a hot air heater that heats air to supply hot air to the drum; a steam generator that generates steam to supply the steam to the drum; and a water tank to hold water to supply to the steam generator, the water tank in flow communication with a water supply hole through which water is supplied into the water tank with the water tank kept in flow communication with the steam generator.

7 Claims, 4 Drawing Sheets

LAUNDRY DRYER

CROSS REFERENCE TO RELATED APPLICATION

This application claims the benefit of the Patent Korean Application No. 10-2006-0090093, filed on Sep. 18, 2006, which are hereby incorporated by reference as if fully set forth herein.

BACKGROUND OF THE DISCLOSURE

1. Field of the Disclosure

The present invention relates to a laundry dryer. More particularly, the present invention relates to a laundry dryer that can prevent as well as remove wrinkles of laundry.

2. Discussion of the Related Art

Laundry dryers are typically electric appliances that dry washed laundry, mainly washed clothes, by using high temperature air. In general, a laundry dryer is configured of a drum, a driving source, heating means and a blower unit. Laundry is held in the drum and the driving source drives the drum. The heating means heats air drawn in the drum. The blower unit sucks or discharges the air inside the drum.

Laundry dryers may be categorized, based on a method of heating air that is heating means, into electric-type laundry dryers and gas-type laundry dryers. In an electric-type laundry dryer, air is heated by using electric resistance heat. While, in a gas-type laundry dryer, air is heated by using heat generated from gas combustion. On the other hand, laundry dryers may be categorized into condensation-type laundry dryers and exhaustion-type laundry dryers. In a condensation-type laundry dryer, air is heat-exchanged with laundry in the drum and the damp air is circulated, not discharged outside, to be heat-exchanged with external air at an auxiliary condenser. At this time, water is condensed and discharged outside. In an exhaustion-type laundry dryer, air is heat-exchanged with laundry in the drum and the damp air is directly discharged outside the laundry dryer. Also, laundry dryers may be categorized, based on a method of loading laundry, into top loading-type laundry dryers and front loading-type laundry dryers. In a top loading-type laundry dryer, laundry is loaded into the drum through a top of the laundry dryer. In a front loading-type laundry dryer, laundry is loaded into the drum through a front of the laundry dryer.

However, above conventional laundry dryers may have following problems.

Commonly, the laundry having performed washing and spinning is loaded and dried in the conventional laundry dryers. In a view of a principle of water washing, washed laundry has wrinkles and the wrinkles created during the washing and spinning are not removed during the drying. As a result, auxiliary ironing is necessary in the conventional laundry dryer to remove the wrinkles, which causes a problem.

Moreover, in case that clothes rather than the washed laundry are kept and used, the clothes like the washed laundry may have wrinkles, crumples and fold marks (hereinafter, referenced to as 'wrinkles'). Accordingly, there have been demands for development of devices capable of removing wrinkles easily even after common usage and keeping.

SUMMARY OF THE DISCLOSURE

Accordingly, the present invention is directed to a laundry dryer.

An object of the present invention is to provide a laundry dryer that can prevent and/or remove wrinkles of laundry.

Another object of the present invention is to provide a laundry dryer that has a simple structure of a steam generation line.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry dryer includes a drum in which laundry is held; a hot air heater that heats air to supply hot air to the drum; a steam generator that generates steam to supply the steam to the drum; and a water tank including a water supply hole for supplying water to the water tank that is mounted in the laundry dryer. It is preferable that the laundry dryer further includes a pump for supplying water of the water tank to the steam generator.

The water supply hole of the water tank may be provided in a predetermined space defined by the drum. Here, the water supply hole may be positioned at a front supporter. It is preferable that the water supply hole is adjacent to a lint filter provided at the front supporter.

The water tank may include a water supply hole cover provided at the water supply hole to selectively open and close the water supply hole.

Therefore, according to the present invention, wrinkles of the laundry can be prevented and/or removed efficiently.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Figure 1:
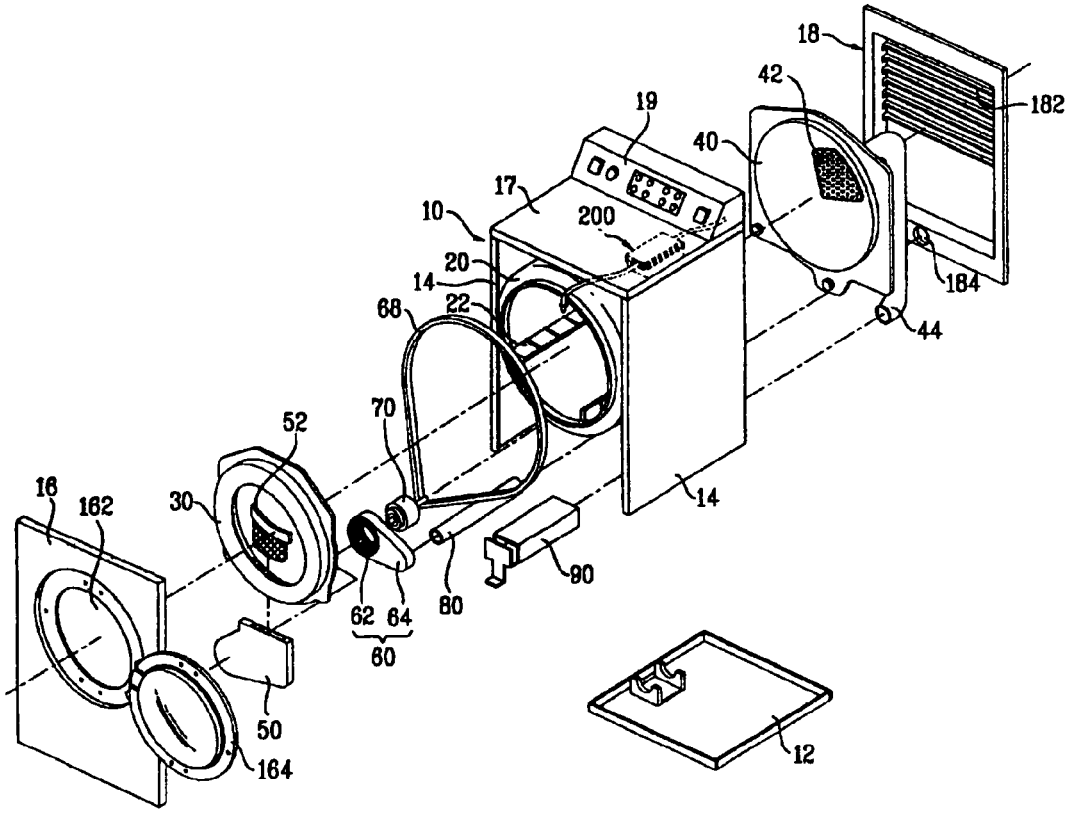
FIG. 1 is a perspective view illustrating an embodiment of a laundry dryer according to the present invention.

Reference will now be made in detail to the specific embodiments of the present invention, examples of which are illustrated in the accompanying drawings. Wherever possible, the same reference numbers will be used throughout the drawings to refer to the same or like parts.

To explain a laundry dryer according to the present invention, a top loading-type, electric-type and exhaustion-type laundry dryer will be presented as examples on convenience sake. However, the present invention is not limited to the above examples and it can be applicable to a front loading-type, gas-type and condensation-type laundry dryer.

In reference to FIGS. 1 and 2, an embodiment of the laundry dryer according to the present invention will be explained.

A cabinet 10 defines an exterior appearance of the laundry dryer and a drum 20 is rotatable in the cabinet 10. A motor 70 and a belt 68 drive the drum 20. A hot air heater 90 is provided in a predetermined portion of the cabinet 10 to heat air and to create high temperature air (hereinafter, hot air). A hot air supply duct 44 is provided in a predetermined portion of the cabinet 10 to supply the hot air of the hot air heater 90 to the drum 20. Also, there are provided an exhaustion duct 80, a blower unit 60 in the laundry dryer according to the present invention. The damp air heat-exchanged with the laundry in the drum 20 is discharged outside the drum 20 through the exhaustion duct 80 and the blower unit 60 sucks the damp air. A steam generator 200 is provided in a predetermined portion of the cabinet 10 to generate high temperature steam. This embodiment presents on convenience sake an indirect drive type in that the drum 20 is rotated by the motor 70 and the belt 68 and the present invention is not limited thereto. That is, it is possible to apply to the present invention a direct drive type in that the drum 20 is directly rotated by connecting the motor 70 to a rear surface of the drum 20.

Each configuration will be explained in detail.

The cabinet 10 defines an exterior appearance of the laundry dryer and it includes a base 12, a pair of side covers 14, a front cover 16, a rear cover 18 and a top cover 17. The base 12 forms a bottom surface of the laundry dryer and the side covers 14 are perpendicular to the base 12. The front cover 16 and the rear cover 18 are installed in a front portion and a rear portion of the side covers 14, respectively. The top cover 17 is installed in an upper portion of the side covers 14. A control panel 19 having various operational switches is positioned at the top cover 17 or the front cover 16 and the door 164 is coupled to the front cover 16. An air inlet 182 and an air outlet 184 are provided at the rear cover 18. External air is drawn through the air inlet 182 and the air inside the drum 20 is discharged outside through the air outlet 184 that is a final path to an outside.

An inner space of the drum 20 is employed as a drying chamber for drying the laundry. It is preferable that a lifter 22 is installed in the drum 20 to lift and drop the laundry, such that the laundry is turned over to enhance drying efficiency.

On the other hand, a front supporter 30 is provided between the drum 20 and the cabinet 10, in other words, between the drum 20 and the front cover 16. A rear supporter 40 is provided between the drum 20 and the rear cover 18. The drum 20 is rotatable between the front supporter 30 and the rear supporter 40, and sealing members (not shown) for preventing water leakage are coupled between the front supporter 30 and the drum 20 and between the drum 20 and the rear supporter 40, respectively. The front supporter 30 and the rear supporter 40 of the drum 20 close a front and a rear surface, respectively, to support a front and rear end of the drum 20 as well as to form the drying chamber.

An opening is formed at the front supporter 30 to communicate the drum 20 with an outside and the opening is selectively opened and closed by the door 164. In addition, a lint duct 50 as a path through which the air in the drum 20 flows outside is connected to the front supporter 30 and a lint filter 52 is installed at the lint duct 50. A predetermined portion of the blower unit 60 is connected to the lint duct 50 and the other opposite predetermined portion of the blower unit 60 is connected to the exhaustion duct 80. Here, the exhaustion duct 80 is in communication with the air outlet 184 provided at the rear cover 18. As a result, once the blower unit 60 is operated, the air inside the drum 20 flows through the lint duct 50, the exhaustion duct 80 and the air outlet 184 in order, only to be exhausted outside. At this time, foreign substances including lint are filtered by the lint filter 52. Commonly, the blower unit 60 is configured of a blower 62 and a blower housing 64. The blower 64 is commonly connected to the motor 70 for driving the drum 20.

An opening 42 formed of plural through-holes is formed at the rear supporter 40 and the hot air supply duct 44 is connected to the opening 42. The hot air supply duct 44 is in communication with the drum 20 and it is employed as a path for supplying hot air to the drum 20. For that, the hot air heater 90 is mounted in a predetermined portion of the hot air supply duct 44.

Figure 3:
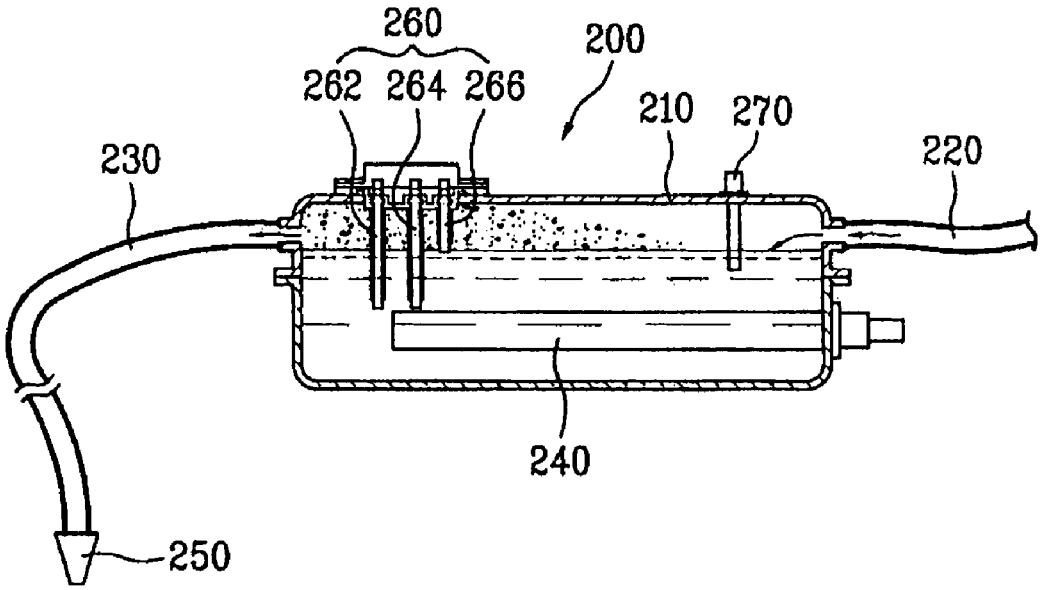
FIG. 3 is a sectional view illustrating a steam generator shown in FIG. 1.

On the other hand, the steam generator 200 is provided in a predetermined portion of the cabinet 10 to generate steam and the generated steam is supplied to the drum 20. In reference to FIG. 3, the steam generator 200 according to one embodiment of the invention will be explained in detail.

The steam generator 200 is configured of a tank 210, a heater 240, a water level sensor 260 and a temperature sensor 270. Water is held in the tank 210 and the heater 240 is mounted in the tank 210. The water level sensor 260 senses water levels in the steam generator 200 and the temperature sensor 270 senses temperatures in the steam generator 200. The water level sensor 260 is configured of a common electrode 262, a low water level electrode 264 and a high water level electrode 266. A high water level is sensed based on whether an electric current is applied between the common electrode 262 and the high water level electrode 266, and a low water level is sensed based on whether an electrode current is applied between the common electrode 262 and the low water level electrode 264.

A water supply hose 220 is connected to a predetermined portion of the steam generator 200 and a steam hose 230 is connected to the other opposite predetermined portion of the steam generator 200. Here, it is preferable that a nozzle 250 having a predetermined shape is provided at a front end of the steam hose 230. An end of the water supply hose 220 is typically connected to an external water supply source such as a water tap. The nozzle 250, that is, a steam outlet is positioned at a predetermined portion in the drum 20 to spray steam in the drum 20.

In the meantime, this embodiment presents a kind of the steam generator 200 in that the heater 240 heats the water in the tank 210 to generate steam (called as "tank heating type steam generator" on convenience sake). Another kind of a steam generator is a heater directly installed around a water supply hose to heat the water in the water supply hose, without storing water in a predetermined space, (called as "a pipe heating type steam generator") may be applicable to the present invention. However, the present invention is not limited to steam generators thereto and any device that generates steam can be used.

Figure 4:
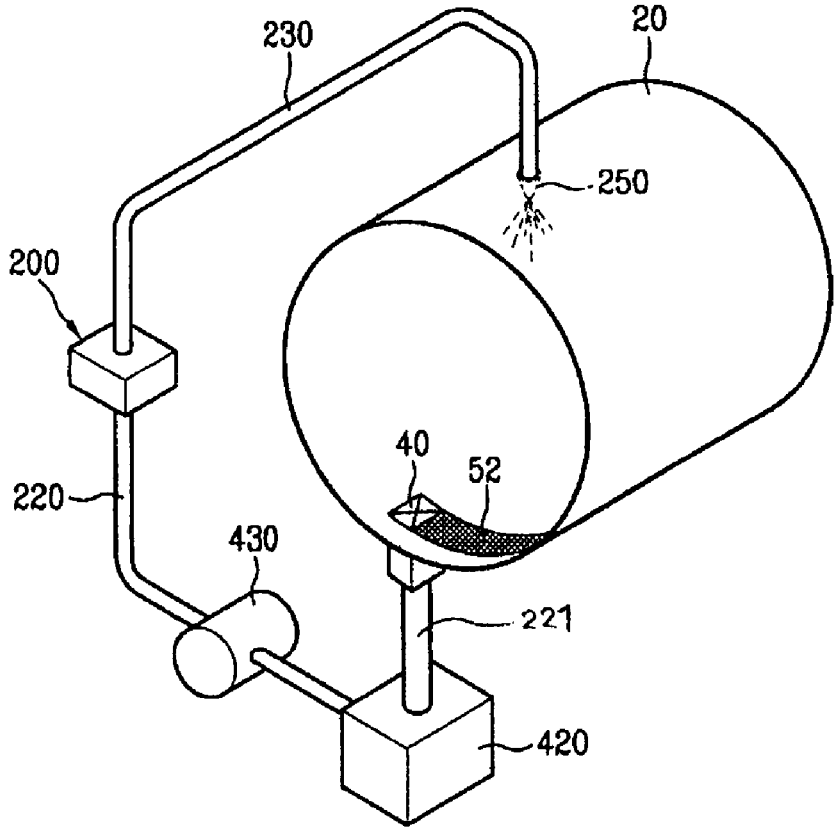
FIG. 4 is a diagram schematically illustrating another embodiment of the laundry dryer according to the present invention.

In reference to FIG. 4, another embodiment of a laundry dryer according to the present invention will be explained.

In this embodiment, a water supply source for supplying water to the steam generator 200 is an auxiliary water tank 420, not an external water tap. If the water supply source may be a water tap described in the above embodiment, the installation of such structure will be complicated. Usually, since water is not used in laundry dryers in case of using a water tap as a water supply source, it is necessary to install corresponding parts for the water tap. As a result, if water of the auxiliary water tank 420 is supplied to steam generator 200, it is convenient of a user.

This embodiment will be described as follows.

The water tank 420 is positioned below the drum 20. a predetermined portion of the water tank 420 is in communication with a water supply hole 40 through which a user supplies water to the water tank 420 and another predetermined portion of the water tank 420 is connected to the steam generator 200. At this time, the water supply hole 40 may be connected to the water tank 420 by a connection hose 221.

It is preferable that the steam generator 200 for generating steam to supply the steam to the drum 20 is positioned higher than the drum 20. In this case, since the water tank 420 is positioned lower than the steam generator 200, the water in the water tank 420 may be provided to the steam generator 200 by using a pump 430. In FIG. 4, a numeral reference 220, 230 and 250 with no description is a water supply hose, a steam hose and a nozzle.

The installation positions of the water tank 420 and the water supply hole 40 will be described.

The water supply hole 40 may be provided at any positions that allow a user to selectively supply water to the water tank through the water supply hole. For example, the water supply hole 40 may be positioned at the top cover 17 (see FIG. 1) and it is connected to the water tank 420 by the connection hose 221. However, it is preferable that the water supply hole 40 is provided at the drum 20. A user may open the door 164 (see FIG. 1) and pour water in the water supply hole 40 to supply water to the water tank 420.

Figure 2:
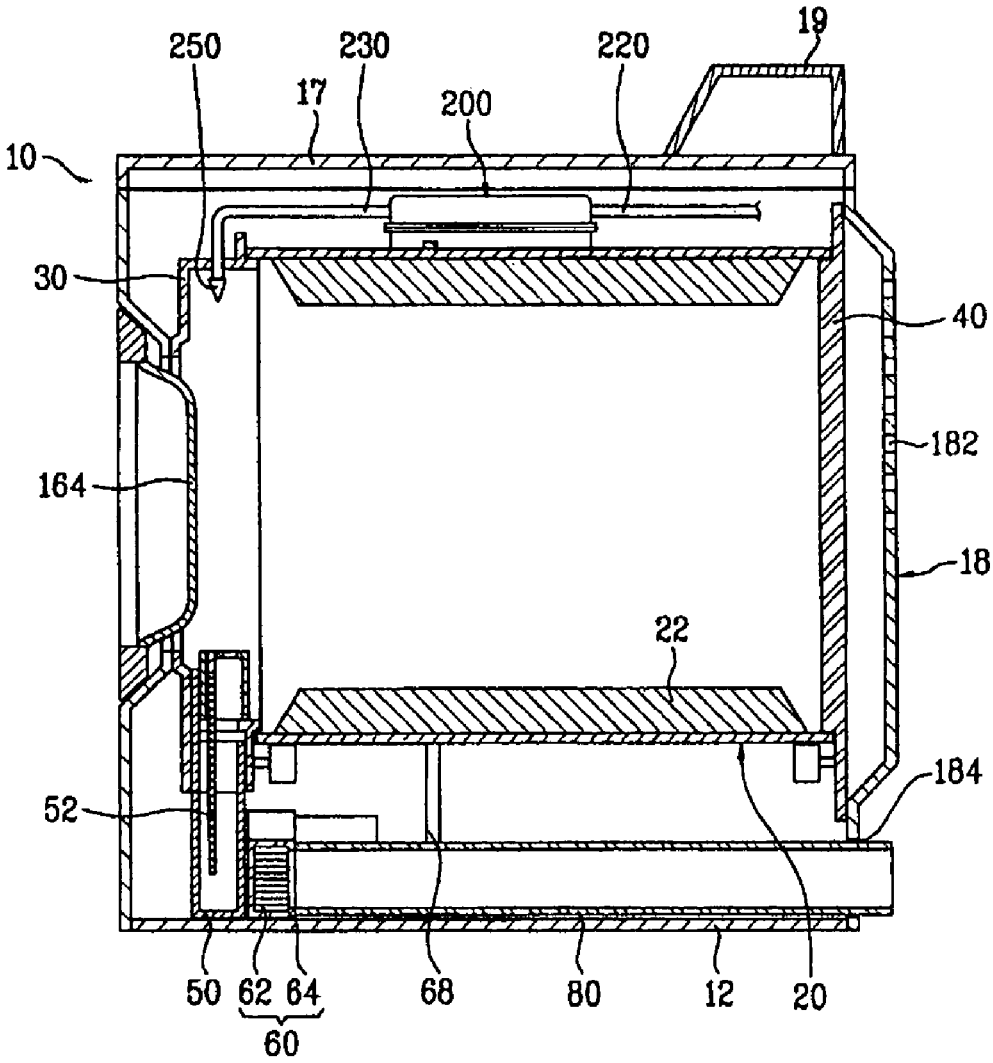
FIG. 2 is a longitudinally sectional view of FIG. 1.

If the water supply hole 40 is provided at the drum 20, it is preferable that the water supply hole 40 is positioned at a front portion of the drum 20, specifically, at the front supporter 30 (see FIG. 1). More specifically, it is preferable that the water supply hole 40 is adjacent to the lint filter provided at the front supporter 30 (see FIG. 1), because the front supporter 30 is not rotated even during the rotation of the drum 20. At this time, it is also preferable that a water supply hole cover (not shown) is provided at the water supply hole 40 to selectively open and close the water supply hole 40, such that lint generated from the laundry may not be drawn into the water tank 420.

On the other hand, it is preferable that the pump 430 is rotated in a clockwise/counter-clockwise direction to supply water to the steam generator 200 or to gather remaining water of the steam generator 200 in the water tank 420. If the steam generator 200 is not used for a relatively long time, there may be damage to the heater because of the remaining water in the steam generator 200 and polluted water may be used. As a result, it is preferable that an auxiliary drain hose (not shown) is provided at the water tank 420 and the water inside the water tank 420 may be discharged outside the laundry dryer if necessary.

In reference to FIG. 4, an operation of the present invention according to the above embodiment will be explained.

A user opens the door and pours water in the water supply hole 40. The poured water is supplied to the water tank 420 through the connection hose 221. Once the laundry dryer is operated in this condition, the water is automatically supplied to the steam generator 200 by the pump 430 based on an operational condition of the laundry dryer selected by the user, for example, an operation using steam. The water is changed into steam in the steam generator 200 and the steam is supplied to the drum 20 to remove wrinkles of the laundry such as clothes.

According to experiments performed by the inventor, although there is difference according to kinds of fabrics and humidity of the laundry, there is an effect of removing and preventing wrinkles in the present invention. For example, wrinkles of the laundry washed in a washer may be removed and the present invention is applicable to various kinds of laundry. For example, clothes worn for about a day, that is, dried laundry with fewer wrinkles may be used in the present invention. In other words, the laundry dryer according to the present invention may be used as a kind of wrinkle removal apparatus.

Therefore, the laundry dryer according to the present invention has following advantageous effects.

First, the laundry dryer according to the present invention has an effect of efficiently preventing wrinkles of the dried laundry in advance. In addition, the laundry may be sterilized and bad smell of the laundry may be removed.

Furthermore, the laundry dryer according to the present invention has another advantageous effect of efficiently removing wrinkles of the dried laundry without auxiliary ironing.

A still further, the laundry dryer according to the present invention has a further advantageous effect of a simple structure, because an external water tap is not connected to the steam generator provided in the laundry dryer.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry dryer comprising:

a cabinet;

a drum to hold laundry;

a hot air heater to heat air that is supplied to the drum;

a front supporter provided between the drum and the cabinet to support a front portion of the drum;

a lint duct connected to the front supporter as a path through which air in the drum flows outside of the drum;

a steam generator to generate steam that is supplied to the drum, wherein the steam generator includes a heater to heat water in the steam generator into steam;

a water tank to hold water that is to be supplied to the steam generator, wherein the water tank is in fluid communication with a water supply hole to receive only water via the water supply hole and to hold the water to be supplied to the steam generator, wherein the water tank is in fluid communication with the steam generator and the water supply hole is positioned at the front supporter separately from the lint duct;

a water supply hole cover adapted to selectively open and close the water supply hole, which is adjacent to a lint filter disposed at the lint duct, to prevent lint generated from laundry entering into the water tank when the air in the drum flows outside of the drum through the lint duct;

a pump for supplying water from the water tank to the steam generator;

a water supply hose connected to the steam generator to supply water via the pump to the steam generator; and a steam hose connected to the steam generator to supply the steam to the drum.

2. The laundry dryer of claim 1, wherein the water tank is disposed in the dryer.

3. The laundry dryer of claim 2, wherein the water supply hole and the water tank are in fluid communication via a connection hose.

4. The laundry dryer of claim 3, wherein the water tank is placed under the drum.

5. The laundry dryer of claim 3, wherein the water supply hole is positioned at a front portion of the drum.

6. The laundry dryer of claim 1, further comprising a drain hose in fluid communication with the water tank to discharge water in the water tank outside the laundry dryer.

7. The laundry dyer of claim 1, wherein the water supply hole is accessible from an interior of the dryer.

* * * * *